United States Patent [19]

Drexler et al.

[11] 4,443,675

[45] Apr. 17, 1984

[54] MULTIPLE CONTACT ARRANGEMENT

[75] Inventors: Johann Drexler, Schwandorf; Peter Pfauntsch, Regensburg, all of Fed. Rep. of Germany

[73] Assignee: Siemens Aktiengesellschaft, Munich, Fed. Rep. of Germany

[21] Appl. No.: 425,910

[22] Filed: Sep. 28, 1982

[30] Foreign Application Priority Data

Nov. 25, 1981 [DE] Fed. Rep. of Germany ..... 3146780

[51] Int. Cl.[3] ..... H01H 1/20

[52] U.S. Cl. ..... 200/243; 200/151; 335/135

[58] Field of Search ..... 200/243, 149 B, 151; 335/135, 133, 128

[56] References Cited

U.S. PATENT DOCUMENTS

| | | | |
|---|---|---|---|
| 2,758,169 | 8/1956 | Weide | 200/243 X |
| 3,548,139 | 12/1970 | Maynard et al. | 335/135 X |
| 3,892,934 | 7/1975 | Richards et al. | 200/250 X |
| 4,262,179 | 4/1981 | Bauer | 200/243 X |
| 4,306,123 | 12/1981 | Taylor | 200/243 X |

FOREIGN PATENT DOCUMENTS

| | | |
|---|---|---|
| 1107771 | 5/1961 | Fed. Rep. of Germany . |
| 1113500 | 9/1961 | Fed. Rep. of Germany . |
| 1133010 | 5/1964 | Fed. Rep. of Germany . |
| 1270655 | 1/1970 | Fed. Rep. of Germany . |

*Primary Examiner*—John W. Shepperd
*Assistant Examiner*—Renee S. Kidorf
*Attorney, Agent, or Firm*—Kenyon & Kenyon

[57] ABSTRACT

A multiple contact arrangement for electromagnetic switchgear is disclosed. The contact arrangement comprises a movably guided contact bridge carrier which holds spring-loaded contact bridges in windows open on one side, the contact bridges being offset in the central part. The contact bridges make electrical contact with fixed contacts which are arranged essentially lined-up with the front edge of each contact bridge carrier window as viewed in the direction of motion of the contact bridge carrier. Partitions are attached to the contact bridge carrier which cooperate with switching chamber housing partitions to form enclosures for each of the contacts. The contact bridges are offset in their central part so that make or break contacts can be formed as desired by reversing the orientation of the contact bridges by 180°. The contact arrangement allows a set of break contacts to be placed between two sets of make contacts.

2 Claims, 2 Drawing Figures

MULTIPLE CONTACT ARRANGEMENT

BACKGROUND OF THE INVENTION

The present invention relates to a multiple contact arrangement, preferably for electromagnetic switchgear having a contact bridge carrier which is movably guided and holds centrally offset contact bridges, the ends of which make electrical contact with fixed contacts, each contact bridge being held in a window of the carrier, the contact bridge ends and the fixed contacts being surrounded by switching chamber partitions forming a part of or attached to the housing containing the contact arrangement.

In a known contact arrangement of the above-mentioned type (German Patent No. 1 133 010), both break and make contacts are provided in the switchgear housing, but the break contacts must be arranged at one end of the housing away from the make contacts because otherwise stray voltages can occur in spite of the existence of the switching chamber partitions. It is an object of the present invention to improve a multiple contact arrangement of the above-mentioned type in such a way that it is possible to arrange a make contact instead of a break contact at any point and vice versa without having to change the design of the contact arrangement and where, in addition, a maximally specified relatively small overall design width is to be maintained.

SUMMARY OF THE INVENTION

In a contact arrangement of the above-mentioned type, these and other objects are achieved by providing partitions extending from the contact bridge carrier between the switching chamber partitions attached to the housing containing the contact arrangement. The contact bridge carrier is provided with "windows" or openings into which the individual contact bridges are placed. Each window has an opening at the top thereof to enable insertion of a contact bridge therein and two window edges. Fixed contacts are arranged essentially lined up with one of these edges, particularly the edge of each window located ahead of the contact bridge as viewed in the direction of motion of the contact bridge carrier. Each fixed contact is positioned behind the respective partition of the contact bridge carrier in its rest position as viewed in the same direction, the depth of the offset of each contact bridge of the make contact in the rest position corresponding to the minimum contact distance of the contact bridge carrier. So that the dimensions can be reduced further without the occurrence of leakage currents and stray voltages, it is advantageous if the partitions are formed integrally with or by attaching them to a bottom plate of the contact bridge carrier. So that the contact bridge carrier can be closed off more or less on one side, but simple assembly, particularly an automatable assembly is still possible, it is furthermore advantageous if the contact bridge carrier is provided with a cover on the side opposite the bottom plate.

BRIEF DESCRIPTION OF THE DRAWINGS

An embodiment of the contact arrangement in accordance with the invention will be described in the following detailed description with reference to the accompanying drawings in which.

DETAILED DESCRIPTION

Figure 1:
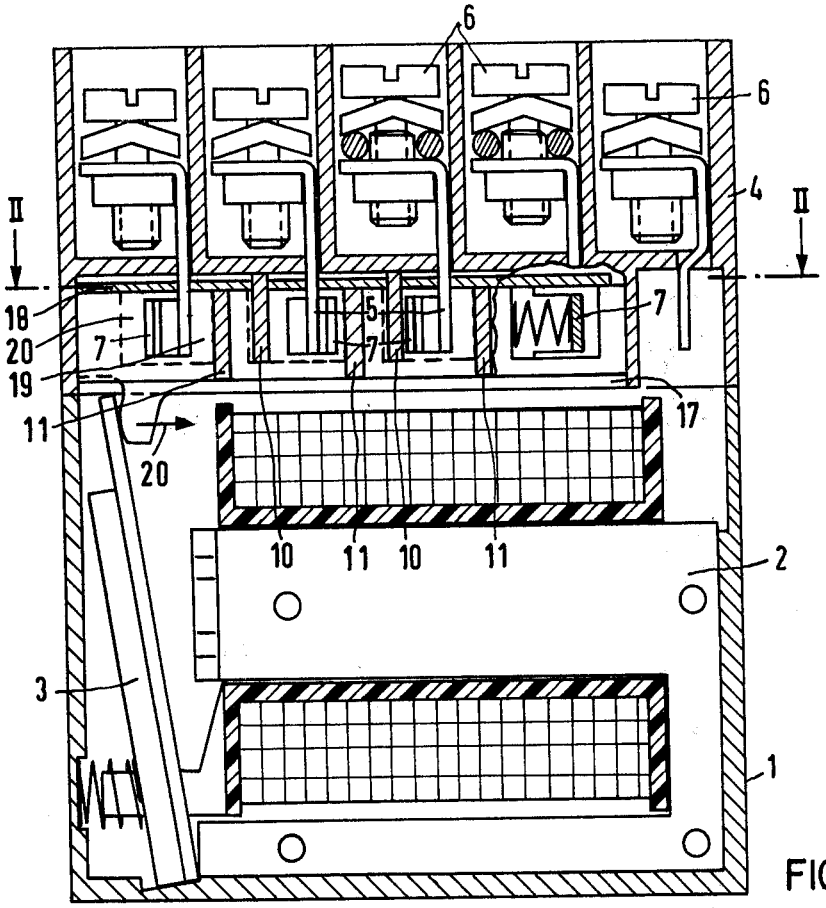
FIG. 1 is a side view of the electromagnetic switchgear partially in cross section.
Figure 2:
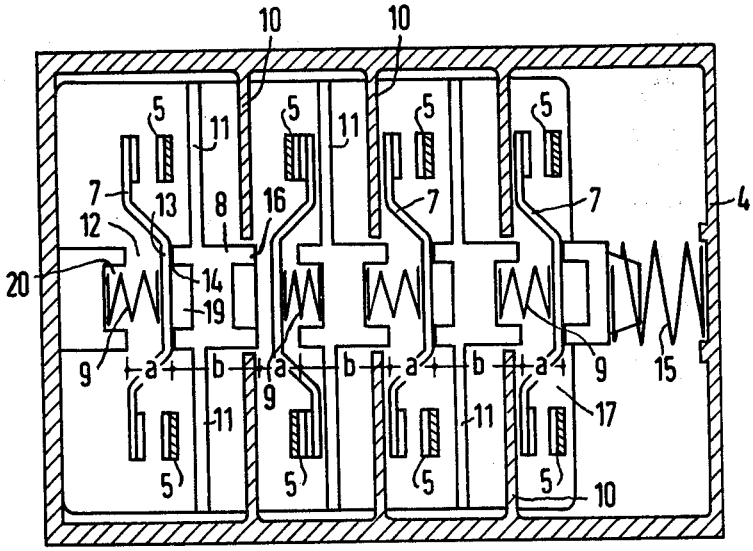
FIG. 2 is a cross-sectional view through the line II—II of FIG. 1.

With reference now to the drawings, the miniature electromagnetic switchgear comprises a lower housing part 1 in which the electromagnet system 2 and armature 3 are located. In an upper housing part 4, the contact arrangement is disposed. The contact arrangement comprises fixed contacts 5 having wire terminal screws 6 and the contact bridges 7 which are movably guided in the contact bridge carrier 8 against the force of springs 9. As shown in FIG. 2, the contact arrangement has, as viewed from left to right, a set of make contacts followed by a set of break contacts followed by two sets of make contacts. To the upper housing part 4 are attached switching chamber partitions 10 which, with the partitions 11 formed integrally with or attached to the contact bridge carrier 8, form labyrinths enclosing each set of contacts. As shown in detail in FIG. 2, the central contact arrangements are disposed between a switching chamber partition 10 and a partition 11 as viewed from left to right. The contact bridge carrier is provided with uniform spacings as indicated by the letters a and b; a corresponds practically to the width of the windows 12 in which the contact bridges are held, and b corresponds to the distance from one window to another. The offset of the contact bridges corresponds essentially to the distance a. The offset part 13 of each make contact bridge touches the window edge 14 in the rest position. If the contact bridge is turned 180° and the position of spring 9 changed as shown in FIG. 2 (see the second contact bridge from the left in FIG. 2), the contact bridge forms a break contact and is pushed against the fixed contact 5 in the rest position by the back pressure spring 9. When the contact bridge carrier is moved by the armature 3 against the spring 15 in the direction of arrow 20, the offset part 13 of the contact bridge 7 rests against the window edge 16 of the window 12. The uniform spacing and the provision of the partitions 11 and the switching chamber partitions 10 make it possible, in contrast to the state of the art, to place the break contacts at any point in the contact arrangement. The so-called European Standard can therefore be met. The European standard regulates the position of the contacts within the multiple contact arrangement. For example, in a contact arrangement including 3 "make" contacts and 1 "break" contact, the arrangement would be as shown in FIG. 2. In an arrangement having 2 "make" contacts and 2 "break" contacts, the arrangement would be as follows: "make", "break", "break", "make". The standard can be found in DIN-EN50011. In order to keep the spacings as small as possible, it is furthermore advantageous to connect a bottom plate 17 to the contact bridge carrier 8, which is preferably formed integrally therewith. A cover 18, as can be seen from FIG. 1, can be put in place loosely over the contact bridge carrier so that partitions 11 slide therebeneath. The cover 18 prevents spark-overs via the switching chamber partition 10 and the partition 11 on the side opposite the bottom plate 17, especially if the break contacts are welded on one side and are then located very close to the following make contact. As shown in FIG. 2, each of the windows 12 are provided with recesses 19 and 20 which position and hold the springs 9. The recess 19 is used to position spring 9 for a break contact arrangement and the recess 20 for a make contact. The recesses make it possible to extend the spring without the need to displace the necessary window edges, i.e., to increase the width of the window. FIG. 2 also shows the lined-up arrangement of the fixed contacts 5 with respect to the window edge 14 which is located ahead of each contact bridge 7 as viewed in the direction of motion of the contact bridge carrier, and the magnitude of the offset 13 equal to the spacing a of the contact bridge 7. Because of the spacing of the window edges 14 and 16 relative to the offset 13 and the position of the fixed contacts 5, it is possible to practically convert break contacts into make contacts and vice versa merely by reversing the orientation of the contact bridges by 180° and changing spring 9 from one recess to the other.

In the foregoing specification, the invention has been described with reference to a specific exemplary embodiment thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. In a multiple contact arrangement for electromagnetic switchgear including a housing, contact bridge carrier means movably guided from a rest position to an actuated position and having a plurality of windows each having a first and second edge for the support of contact bridge means, said windows being arranged at intervals evenly distributed along the length of said contact bridge carrier means, contact bridge means supported in each of said windows having electrical contact means at each end thereof, said electrical contact means being offset from the central portion of said contact bridge means, fixed electrical contact means for engaging said electrical contact means of said contact bridge means and first partitioning means attached to said housing for separating each of said contact bridge means from each other, the improvement comprising:

second partitioning means attached to said contact bridge carrier means adjacent said first partitioning means and further separating said contact bridge means from each other;

plate means below said contact bridge carrier means from which said second partitioning means extend;

said fixed electrical contact means arranged in linear relation with said second edge of each of said windows when said contact bridge carrier is in said rest position; and said ends of said contact bridge means each being offset from the central portion of each of said contact bridge means a distance equal to the spacing between said first and second edges;

whereby said contact bridge means can be inserted into said windows in either of two orientations, said orientations being 180° opposite each other, so that said electrical contact means of said contact bridge means contacts said fixed electrical contact means in said rest position if it is inserted into said window in one of said orientations and contacts said fixed electrical contacts in said actuated position if it is inserted into said window in the second orientation.

2. The improvement recited in claim 1 further comprising cover means provided above said contact bridge means.

* * * * *